US005299552A

United States Patent [19]

Kubo

[11] Patent Number: 5,299,552

[45] Date of Patent: Apr. 5, 1994

[54] METHOD AND APPARATUS FOR CUTTING CIRCULAR OPENING IN STRUCTURE

[75] Inventor: Setsuo Kubo, Kyoto, Japan

[73] Assignee: Kabushiki Kaisha Dymosha, Kyoto, Japan

[21] Appl. No.: 2,264

[22] Filed: Jan. 8, 1993

[30] Foreign Application Priority Data

Jan. 16, 1992 [JP] Japan ..... 4-024386

[51] Int. Cl.[5] ..... B28D 1/08

[52] U.S. Cl. ..... 125/21; 51/241 B; 83/661

[58] Field of Search ..... 125/21, 13.01; 51/241 S, 241 B; 83/661

[56] References Cited

U.S. PATENT DOCUMENTS

| | | | |
|---|---|---|---|
| 2,297,074 | 9/1942 | Rohrdanz | 51/241 B |
| 3,378,307 | 4/1968 | Dempsey . | |
| 4,633,848 | 1/1987 | Bresciani | 125/21 |
| 5,001,870 | 3/1991 | Yokota . | |
| 5,016,354 | 5/1991 | Baine . | |

FOREIGN PATENT DOCUMENTS

| | | | |
|---|---|---|---|
| 3923970 | 1/1991 | Fed. Rep. of Germany | 125/21 |
| 57-71506 | 5/1982 | Japan . | |
| 58-65422 | 5/1983 | Japan . | |
| 59-1711 | 1/1984 | Japan . | |
| 59-24404 | 2/1984 | Japan . | |
| 59-24405 | 2/1984 | Japan . | |
| 59-156912 | 10/1984 | Japan . | |
| 59-163607 | 11/1984 | Japan . | |
| 60-135306 | 9/1985 | Japan . | |
| 61-125514 | 8/1986 | Japan . | |
| 61-130613 | 8/1986 | Japan . | |
| 61-169112 | 10/1986 | Japan . | |
| 61-206707 | 12/1986 | Japan . | |
| 62-125109 | 6/1987 | Japan . | |
| 62-159509 | 10/1987 | Japan . | |
| 62-159510 | 10/1987 | Japan . | |
| 63-27519 | 2/1988 | Japan . | |
| 63-55204 | 3/1988 | Japan . | |
| 63-57803 | 3/1988 | Japan . | |
| 2-108789 | 4/1990 | Japan . | |

*Primary Examiner*—Robert A. Rose

*Attorney, Agent, or Firm*—Armstrong, Westerman, Hattori, McLeland & Naughton

[57] ABSTRACT

A circular opening is formed in a structure by: forming through-holes 4, 3 in the structure 1 to be cut on a circular cutting line 2 and at the center of the circular cutting line; inserting a shaft 5 through the center through-hole 3; securing support arms 13, 20 to both ends of the shaft 5; passing an endless wire saw 23 through the through-holes 4 on the cutting line and around pulleys 15, 22 mounted on the support arms 13, 20; and driving the wire saw 23 by a drive unit while rotating the support arms 13, 20 about the shaft 5.

The apparatus for cutting a circular opening in a structure comprises: a shaft inserted through a through-hole formed in a structure to be cut; support arms secured to both ends of the shaft; pulleys mounted to the support arms; an endless wire saw passed through through-holes formed in the structure along a line connecting the pulleys around the pulleys; a pulley drive unit; and a support arm rotating unit. With this method and light-weight apparatus, a circular opening of a large diameter can be stably made in a structure.

2 Claims, 2 Drawing Sheets

METHOD AND APPARATUS FOR CUTTING CIRCULAR OPENING IN STRUCTURE

BACKGROUND OF THE INVENTION

1. Field of the Invention

The present invention relates to a method and an apparatus for cutting a concrete structure by a wire saw to form a circular opening in the wall or floor of the concrete structure.

2. Description of the Prior Art

In order to cut a circular opening in a road surface, conventionally a center shaft is erected at the center of a circular portion of a road surface to be cut, a cylindrically-cutting member supported by the center shaft and rotatable about the center shaft is set, cutting blades are attached to the underside of the cylindrically-cutting member, the cylindrically-cutting member is rotated while being pressed against a member being cut, and the cylindrically-cutting member is advanced in the cutting direction as the cutting proceeds.

SUMMARY OF THE INVENTION

In the above conventional apparatus, the maximum diameter of a portion of a road surface to be cut is approximately 1.5 m due to the limits of the weight, strength, driving force and cutting stability of the cylindrically-cutting member. The thickness of a road surface to be cut is about 50 cm at the most. As to walls and floors of structures, the diameter of a circular opening formed therein is about 80 cm at the most. Under these situations, there have been demands for development of a technology that allows stable cutting of a larger diameter opening.

The object of this invention therefore is to provide a method of stably cutting a circular opening of a larger diameter in a structure and an apparatus therefore.

To solve the above problem, according to the present invention a method of cutting a circular opening in a structure to be cut comprises the steps of: forming through-holes in the structure on the circular cutting line and at the center of the circular cutting line; inserting a shaft through the center through-hole; securing support arms to both ends of the shaft; passing an endless wire saw through the through-hole on the cutting line and extending the endless wire saw about pulleys mounted on the support arms; and driving the wire saw by a drive unit while rotating the support arms about the shaft.

The apparatus for cutting a circular opening in a structure comprises: a shaft inserted through a through-hole formed in a structure to be cut; support arms secured to both ends of the shaft; pulleys mounted to the support arms; an endless wire saw passed through a through-hole formed in the structure along a line connecting the pulleys, the endless wire saw being passed on the pulleys; a pulley drive unit; and a support arm rotating unit. With this lightweight apparatus, a circular opening of a large diameter can be stably formed in a structure.

Since the apparatus of the invention is structured as described above, a structure is cut along a circular cutting line by forming through-holes in the structure to be cut on a circular cutting line and at the center of the circular cutting line; inserting a shaft through the center through-hole; securing support arms to both ends of the shaft; passing an endless wire saw through the through-hole on the cutting line and passing the endless wire saw about pulleys mounted on the support arms; and driving the wire saw by a drive unit while rotating the support arms about the shaft.

DESCRIPTION OF THE PREFERRED EMBODIMENT

Figure 1:
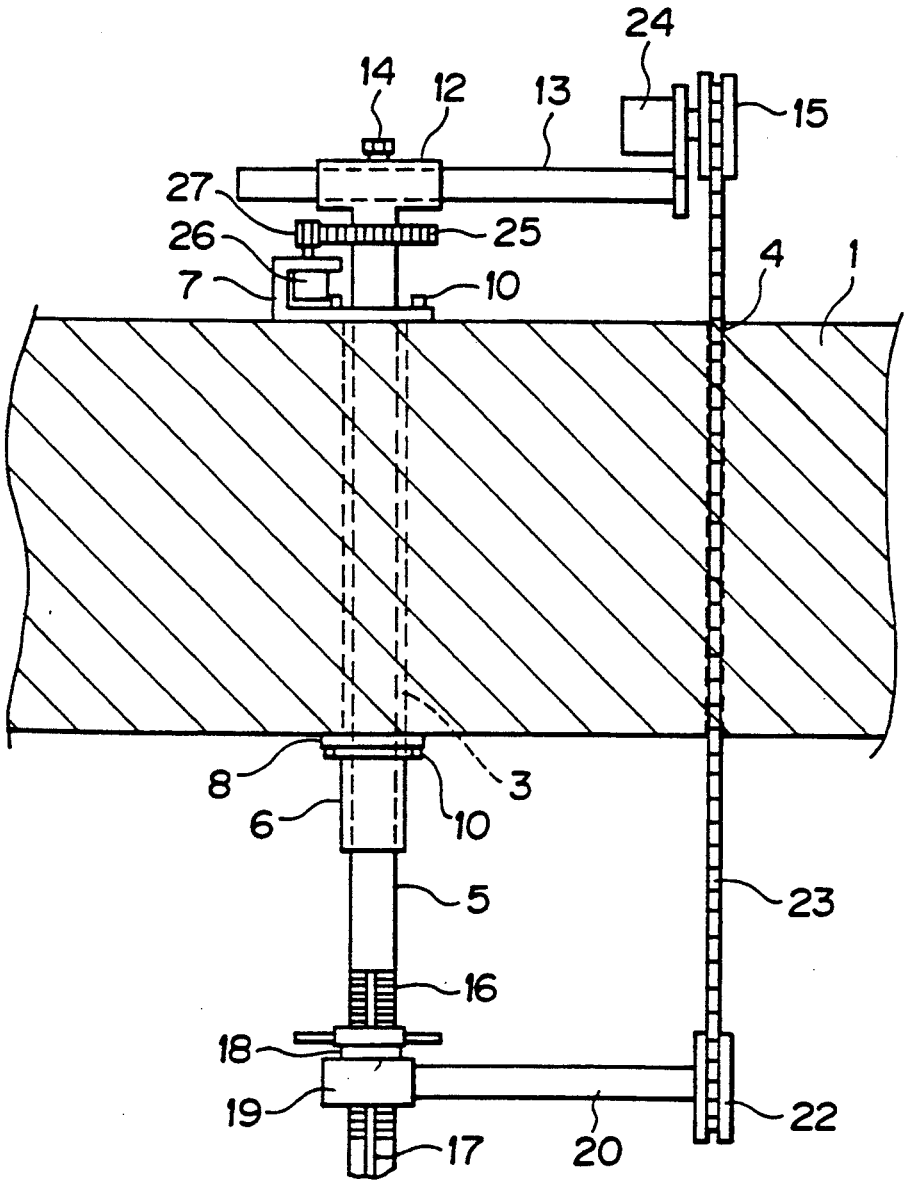
FIG. 1 is a side view of an embodiment of this invention.
Figure 2:
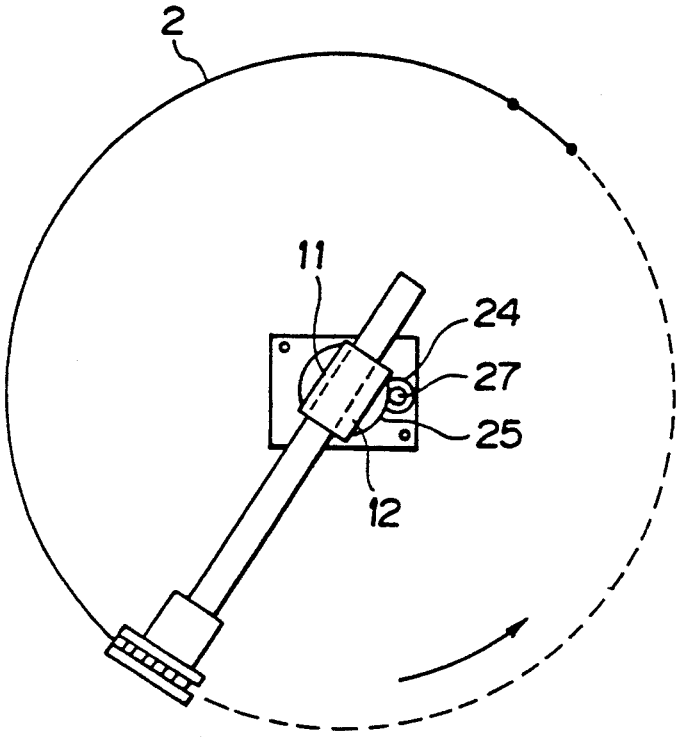
FIG. 2 is a plan view of the embodiment of the invention.
Figure 3:
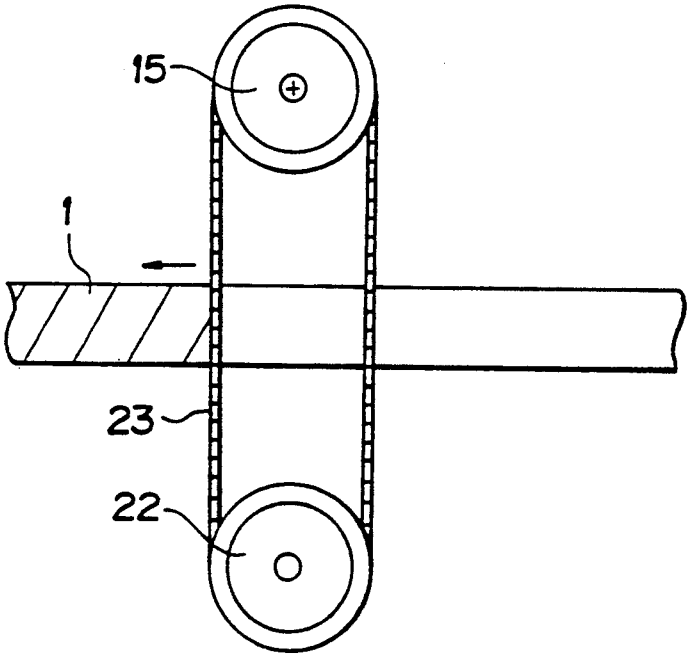
FIG. 3 is a side cross section of a cut portion of the embodiment.

An embodiment of this invention will be described by referring to the attached drawings. As shown in FIG. 1 and 2, a structure 1 to be cut such as a floor and a wall is formed with a center through-hole 3 at the center of a circular cutting line 2. Two through-holes 4 large enough for a wire saw to be inserted therethrough are formed in the structure on the circular cutting line 2.

A shaft 5 is inserted through the center through-hole 3. A sleeve 6 is fitted on the shaft 5, and a U-shaped upper retaining plate 7 fitted to the sleeve 6 is placed in contact with the surface of the structure 1 to be cut and secured to the structure 1 by anchor bolts 10, thus firmly supporting the shaft 5 at the center of the structure 1 to be cut. A lower retaining plate 8 fitted to the sleeve 6 is also placed in contact with the underside of the structure 1 and secured to it by anchor bolts 10 or the like. The sleeve 6 may be formed with an outer thread so that the upper and lower retainer plates 7, 8 are screwed to the sleeve 6. The sleeve 6 may also be fitted on the shaft 5 through bearing.

The shaft 5 has a first arm fixing member 12 formed integral with the shaft 5 and having a through-hole 11. A first arm 13 is inserted through the through-hole 11 of the first arm fixing member 12 and fixed by an adjusting bolt 14. The length of the first arm 13 is adjusted and fixed by the adjusting bolt 14 so that a first pulley 15 is located above the circular cutting line 2.

The other end of the shaft 5 is formed with a thread 16 and a key way 17. An adjusting member 18 is engaged with the thread of the shaft 5. A second arm fixing member 19 is provided with a projection that fits in the key way 17 so that it can be slid along the key way 17. A second adjusting member located on the other side of the second arm fixing member 19 with respect to the first adjust member may be screwed on the shaft 5.

A second arm 20 is passed through the through-hole in the second arm fixing member 19. The adjust member 18 is turned and moved in an axial direction of the shaft 5, causing the second arm fixing member 19 to be moved along the key way 17 to a desired position. The second arms 20 are prepared in a variety of lengths. The length of the second arm 20 is adjusted and fixed so that it is equal to the adjusted length of the first arm 13.

The second arm 20 is provided at its end with a second pulley 22. An endless wire saw 23 is passed through the through-hole 4 in the structure 1 around the first pulley 15 and the second pulley 22. The first pulley 15 is driven by a motor 24 mounted to the first arm 13.

The shaft 5 has a gear 25 secured thereto, which is in mesh with a gear 27 of the motor 26 fixed to the U-shaped upper retaining plate 7. As the motor 26 turns, the driving force is transmitted through the gear 27 to the first arm fixing member 12, which is rotated about the shaft 5. As a result, the first arm 13 is turned.

An apparatus for cutting a circular opening in a structure according to this invention is assembled as described above. The apparatus is operated as follows. The wire saw 23 is driven by the motor 24, and the first arm 13 is rotated by the motor 26 causing the wire saw 23 to move along the circular cutting line on the structure 1 to be cut. In this way, a circular opening is made in the structure 1. As the cutting proceeds, the second arm 20 also rotates in the same direction. When the wire saw 23 becomes loose, the adjust member 18 is turned and moved toward the end of the shaft 5 so as to move the second arm fixing member 19 toward the shaft end, thus keeping the wire saw 23 in a specified tension.

Though, in the above embodiment, the motor 26 is used as a first arm rotating means, the first arm may be driven manually. The motors 24, 26 may be of an electric type or hydraulic type. It is also possible to provide pulleys and drive motors to both ends of the first and second arms so that the structure can be cut by two wire saws passing around the both ends of the arms. In this case, the circular cutting is done by rotating the arms through 180 degrees.

This invention is not limited to the above embodiment alone and includes various modifications that can be made by any person skilled in the art within the scope of the invention covered by the claims.

Since this invention has the above-mentioned configuration, the apparatus can be made light and small, and can cut a circular opening of a very large diameter. Moreover, a variety of structures can be cut in the thickness ranging from 10 cm to 5 m. Since the wire saw can cut concrete materials containing iron reinforced bars, it is possible to form not only circular openings in floors or natural lighting windows in walls but also circular openings in dam walls. The apparatus therefore can be applied for a wide range of applications.

Furthermore, the wire saw is only required to be long enough to cover the thickness of the structure to be cut and the pulley winding length. In other words, it is only necessary to use the minimum length of the wire saw which is determined according to the thickness of the structure and the cutting area defined by the cutting length. This minimizes the amount of use of the expensive wire saw, which reduces the cost of the apparatus and the amount of expansion of the wire saw, assuring a stable cutting operation.

What is claimed is:

1. A method of cutting a circular opening in a structure comprising the steps of:

forming through-holes in the structure to be cut on a circular cutting line and at the center of the circular cutting line;

inserting a shaft through the center through-hole with opposite ends of shaft extending outwardly from upper and lower surfaces of the structures;

securing support arms to both ends of the shaft with each of the support arms having a longitudinal axis extending radially from the longitudinal axis of said shaft;

passing an endless wire saw through the through-hole on the cutting line and passing the endless wire saw around pulleys mounted on the support arms, such that the rotational axis of each pulley is parallel to the longitudinal axis of the respective support arm; and driving the wire saw by a drive unit while rotating the support arms about the shaft.

2. An apparatus for cutting a circular opening in a structure comprising:

a shaft inserted through a through-hole formed in a structure to be cut with opposite ends of shaft extending outwardly from upper and lower surfaces of the structures;

support arms secured to both ends of the shaft with each of the support arms having a longitudinal axis extending radially from the longitudinal axis of said shaft;

pulleys mounted to the support arms, the rotational axis of each pulley being parallel to the longitudinal axis of the respective support arm;

an endless wire saw passed through through-holes formed in the structure along a line connecting the pulleys around the pulleys;

a pulley drive unit; and a support arm rotating unit.

* * * * *